US011198456B2

(12) United States Patent
Leitgeb et al.

(10) Patent No.: US 11,198,456 B2
(45) Date of Patent: Dec. 14, 2021

(54) SPRING ARRANGEMENT FOR A RAIL VEHICLE

(71) Applicant: SIEMENS MOBILITY GmbH, Vienna (AT)

(72) Inventors: Andreas Leitgeb, Graz (AT); Martin Teichmann, Gratkorn (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 327 days.

(21) Appl. No.: 16/478,765

(22) PCT Filed: Jan. 16, 2018

(86) PCT No.: PCT/EP2018/050931
§ 371 (c)(1),
(2) Date: Jul. 17, 2019

(87) PCT Pub. No.: WO2018/134174
PCT Pub. Date: Jul. 26, 2018

(65) Prior Publication Data

US 2020/0047776 A1 Feb. 13, 2020

(30) Foreign Application Priority Data

Jan. 18, 2017 (AT) ..... A 50033/2017

(51) Int. Cl.
*B61F 5/04* (2006.01)
*B61F 5/06* (2006.01)
*B61F 5/12* (2006.01)

(52) U.S. Cl.
CPC ..... *B61F 5/04* (2013.01); *B61F 5/06* (2013.01); *B61F 5/127* (2013.01)

(58) Field of Classification Search
CPC ..... B61F 5/04; B61F 5/06; B61F 5/10; B61F 5/127; B61F 5/14
See application file for complete search history.

(56) References Cited

U.S. PATENT DOCUMENTS 4,294,175 A * 10/1981 Harsy ..... B61F 5/16 105/199.3
5,666,885 A * 9/1997 Wike ..... B61F 5/36 105/168

(Continued)

FOREIGN PATENT DOCUMENTS

CN 201296253 8/2009
CN 103661463 3/2014

(Continued)

*Primary Examiner* — Jason C Smith
(74) *Attorney, Agent, or Firm* — Cozen O'Connor

(57) ABSTRACT

A spring arrangement for a vehicle, particularly a rail vehicle with at least one wagon and at least one bogie, wherein so as to create favorable construction conditions the spring arrangement includes at least one suspension spring, at least one pre-stressed damping spring, a contact body connected to the damping spring, and at least one first auxiliary spring, where a first longitudinal axis of the suspension spring, a second longitudinal axis of the damping spring, a third longitudinal axis of the contact body, and a fourth longitudinal axis of the first auxiliary spring are arranged parallel to each other, and where the contact body is arranged between the damping spring and the first auxiliary spring such that a low level of overall rigidity of the spring arrangement is obtained for a height adjustment of the vehicle.

19 Claims, 3 Drawing Sheets

(56) References Cited

U.S. PATENT DOCUMENTS

| | | | | |
|---|---|---|---|---|
| 2004/0016361 | A1* | 1/2004 | Teichmann | B61D 47/00 105/164 |
| 2020/0047776 | A1* | 2/2020 | Leitgeb | B61F 5/02 |
| 2020/0062282 | A1* | 2/2020 | Hoffmann | B61F 5/325 |
| 2020/0130712 | A1* | 4/2020 | Becher | B61F 5/30 |

FOREIGN PATENT DOCUMENTS

| | | |
|---|---|---|
| DE | 2822183 | 10/1979 |
| DE | 3412547 | 10/1985 |
| DE | 19651138 | 6/1997 |
| DE | 10315000 | 11/2003 |
| DE | 202005009909 | 10/2006 |
| DE | 102015016024 | 6/2016 |
| NL | 7902653 | 10/1979 |

* cited by examiner

SPRING ARRANGEMENT FOR A RAIL VEHICLE

CROSS-REFERENCE TO RELATED APPLICATIONS

This is a U.S. national stage of application No. PCT/EP2018/050931 filed Jan. 16, 2018. Priority is claimed on AT Application No. A50033/2017 filed Jan. 18, 2017, the content of which is incorporated herein by reference in its entirety.

BACKGROUND OF THE INVENTION

1. Field of the Invention

The invention relates to a spring arrangement for a vehicle, particularly a rail vehicle having at least one car body and at least one running gear.

2. Description of the Related Art

The height of car bodies is frequently adjusted, particularly in the case of vehicles involved in local and regional transport, such as when vehicles stop at stations to achieve a low entrance height or rather a level entrance for passengers into the vehicle.

In the case of vehicles in which the secondary spring is not configured as a pneumatic spring but rather, for example, is configured as a helical spring, the height may be adjusted by pulling the car body down against the effect of the helical spring, which requires the application of great forces.

DE 10 2015 016 024 A1 describes an exemplary spring system for a rail vehicle having a spring strut. The spring strut comprises a hydraulic cylinder having a piston guided therein, where the piston is connected to a suspension spring between a car body and a running gear. A height of the suspension spring or rather a spring deflection distance is influenced dependent upon the pressure relationships in the hydraulic cylinder.

DE 103 15 000A1 discloses a height adjustment procedure for a rail vehicle, where an actuator acts on a spring stage between a car body and a substructure such that the car body may be lowered and raised against a restoring force of the spring stage.

SUMMARY OF THE INVENTION

It is an object of the present invention to provide an improved spring arrangement in comparison to the prior art.

This and other objects and advantages are achieved in accordance with the invention by a spring arrangement having at least one suspension spring, at least one prestressed damping spring, a contact body, which is connected to the at least one damping spring, and also at least one first auxiliary spring, where a first longitudinal axis of the at least one suspension spring, a second longitudinal axis of the at least one damping spring, a third longitudinal axis of the contact body and a fourth longitudinal axis of the at least first auxiliary spring are arranged parallel to one another, and where the contact body is arranged between the at least one damping spring and the at least first auxiliary spring.

As a consequence, a low overall stiffness of the spring arrangement is achieved for a height adjustment procedure, in other words in an operation where the vehicle stops at stations, without impairing the stiffness relationship of the spring arrangement in a drive operation of the vehicle, i.e., for example, while the vehicle is traveling.

If the spring arrangement is used for the height adjustment procedure of the car body and if the suspension spring is arranged between the car body and running gear, then the forces required to lower the car body are reduced on account of the low overall stiffness.

As a result, components of the spring arrangement (e.g., a hydraulic cylinder, which via the hydraulic piston provides forces that act against the suspension spring and the first auxiliary spring so as to adjust the height and thus pull the car body, for example, downward), may be configured in a light and compact manner.

It is expedient if a first hydraulic piston that contacts the at least one damping spring that is arranged in the hydraulic cylinder is arranged protruding into a hydraulic cylinder.

It is furthermore advantageous if a piston rod that is connected to the at least one running gear is arranged protruding into the hydraulic cylinder.

By virtue of configuring the hydraulic cylinder as a housing for the damping spring, on the one hand, a particularly compact arrangement is achieved and, on the other hand, high pressures are generated via the hydraulic cylinder.

With the hydraulic cylinder, forces are applied to the piston rod via the first hydraulic piston, as a result of which the car body is lowered.

In one advantageous embodiment, a second hydraulic piston that is configured as an actuator with respect to the first hydraulic piston is arranged in the hydraulic cylinder, where the second hydraulic piston is connected to the piston rod via a compression spring. As a result, a series connection of the first hydraulic piston to the second hydraulic piston is achieved. The first hydraulic piston acts, in this case, on the damping spring and the second hydraulic piston acts on the piston rod. If the piston rod is connected to the running gear or to the car body, then then piston rod follows the dynamic movements of the running gear or of the car body, for example, while the vehicle is traveling. These movements act via its connection to the piston rod on the second hydraulic piston. As a result, the damping spring is decoupled therefrom and may therefore be configured in a compact manner.

Other objects and features of the present invention will become apparent from the following detailed description considered in conjunction with the accompanying drawings. It is to be understood, however, that the drawings are designed solely for purposes of illustration and not as a definition of the limits of the invention. It should be further understood that the drawings are not necessarily drawn to scale and that, unless otherwise indicated, they are merely intended to conceptually illustrate the structures and procedures described herein

BRIEF DESCRIPTION OF THE DRAWINGS

The invention is further explained below with reference to exemplary embodiments, in which.

DETAILED DESCRIPTION OF THE EXEMPLARY EMBODIMENTS

Figure 1:
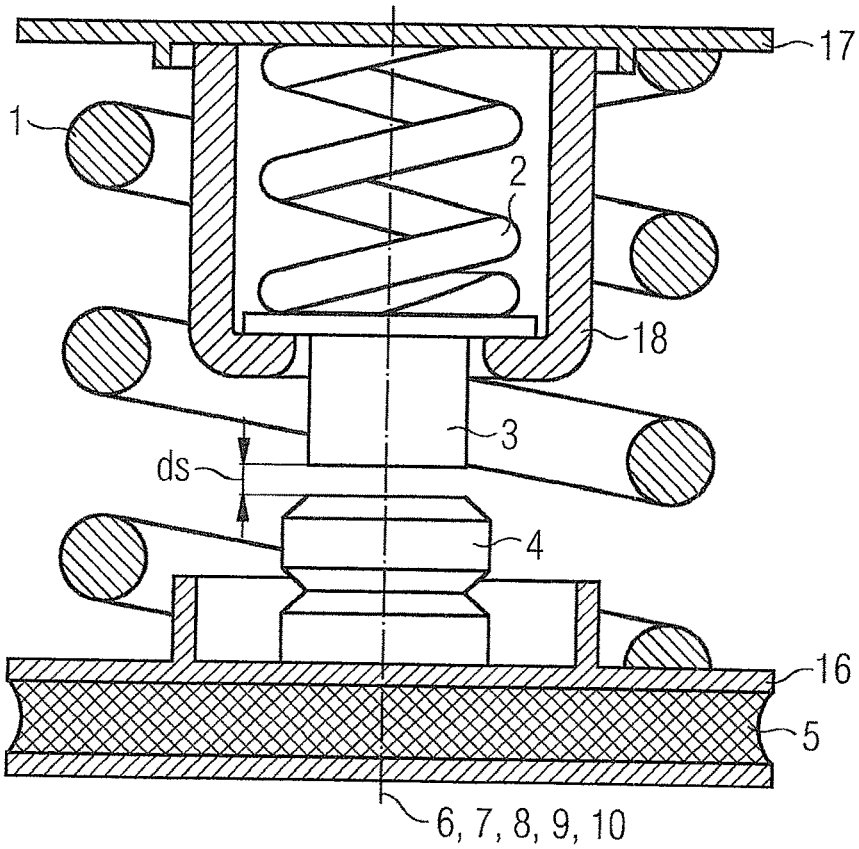
FIG. 1 shows a sectional representation of a side view of a first exemplary embodiment of a spring arrangement in accordance with the invention.

A first exemplary embodiment of a spring arrangement in accordance with the invention illustrated in FIG. 1 comprises a suspension spring 1 that is configured as a steel helical spring having a base plate 16 and a cover plate 17. The cover plate 17 is connected to a car body of a rail vehicle, the base plate 16 is connected to a running gear via a second auxiliary spring 5 that is configured as a layer spring. A prestressed damping spring 2 is provided within the suspension spring 1, where the damping spring 2 is configured as a steel helical spring and is arranged in a housing 18. The housing 18 is connected via its upper face to the cover plate 17 and comprises an opening via which a contact body 3 that is configured as a plunger and is connected to the damping spring 2 is guided outward. The contact body 3 is therefore mounted between a lower face of the housing 18 and the damping spring 2.

A first auxiliary spring 4 that is configured as an elastomer spring or rather as a rubber buffer is provided below the contact body 3 and likewise within the suspension spring 1, where the first auxiliary spring is connected via its lower face to the base plate 16. A first longitudinal axis 6 of the suspension spring 1, a second longitudinal axis 7 of the damping spring 2, a third longitudinal axis 8 of the contact body 3, a fourth longitudinal axis 9 of the first auxiliary spring 4 and a fifth longitudinal axis 10 of the second auxiliary spring 5 are arranged congruent with one another.

Figure 2:
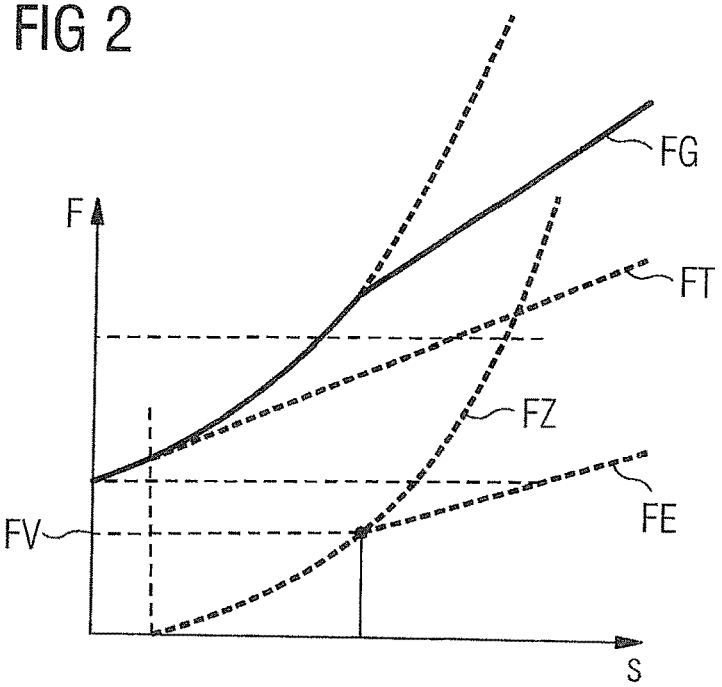
FIG. 2 shows a spring diagram relating to the first exemplary embodiment of the spring arrangement of FIG. 1 in accordance with the invention.

FIG. 2 illustrates a spring rate diagram (force-/deflection distance, F/s-diagram) with respect to the arrangement illustrated in FIG. 1. If the suspension spring 1 is compressed, then the contact body 3 after overcoming a deflection distance ds that is illustrated in the figure comes into contact with the first auxiliary spring 4. As a result, a series connection of the damping spring 2 to the first auxiliary spring 4 is produced. The damping spring 2 and the first auxiliary spring 4 are connected in parallel to the suspension spring 1.

Figure 3:
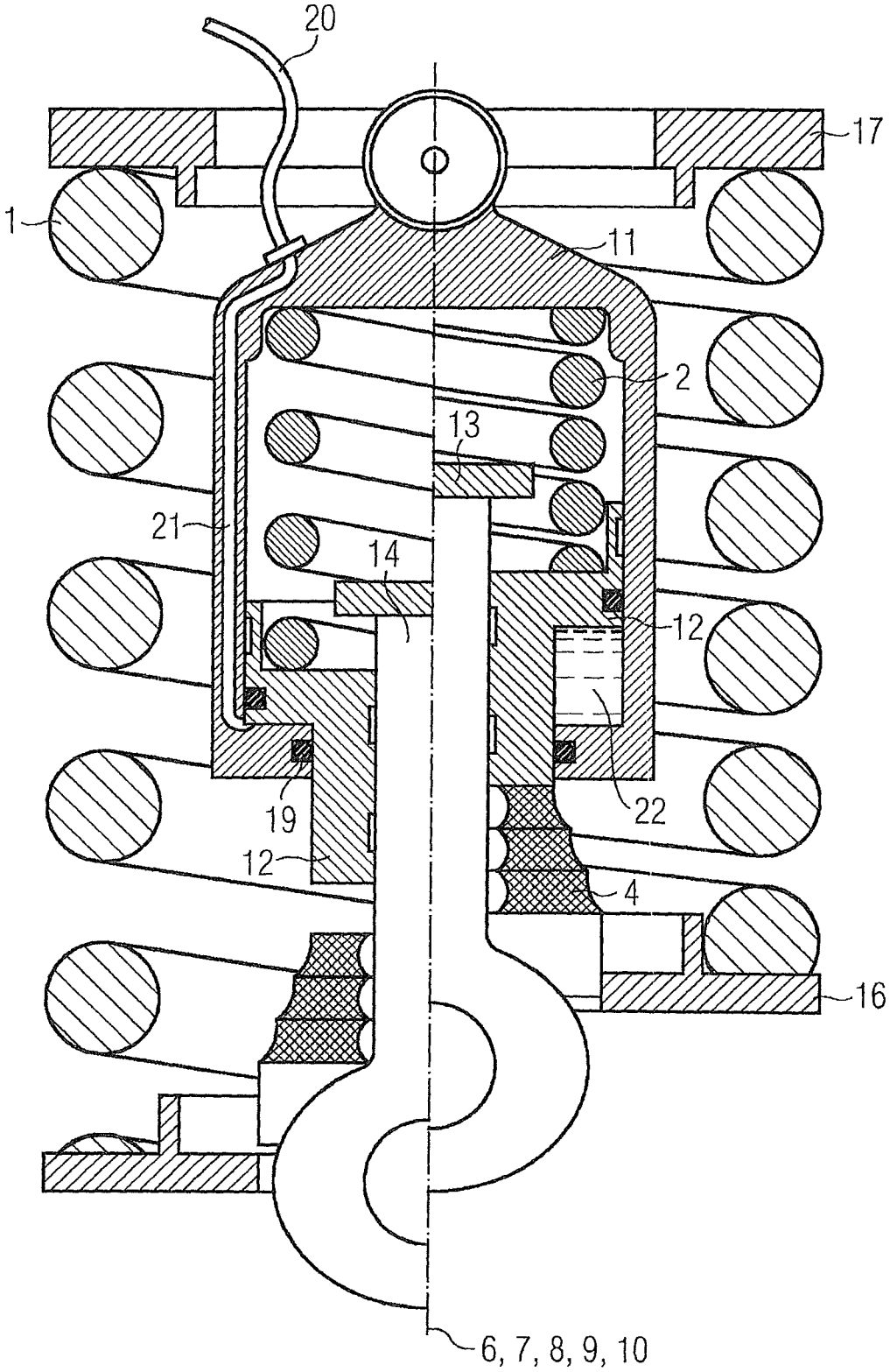
FIG. 3 shows a sectional representation of another exemplary embodiment of a spring arrangement in accordance with the invention, where a hydraulic cylinder is illustrated with a first hydraulic piston.
Figure 4:
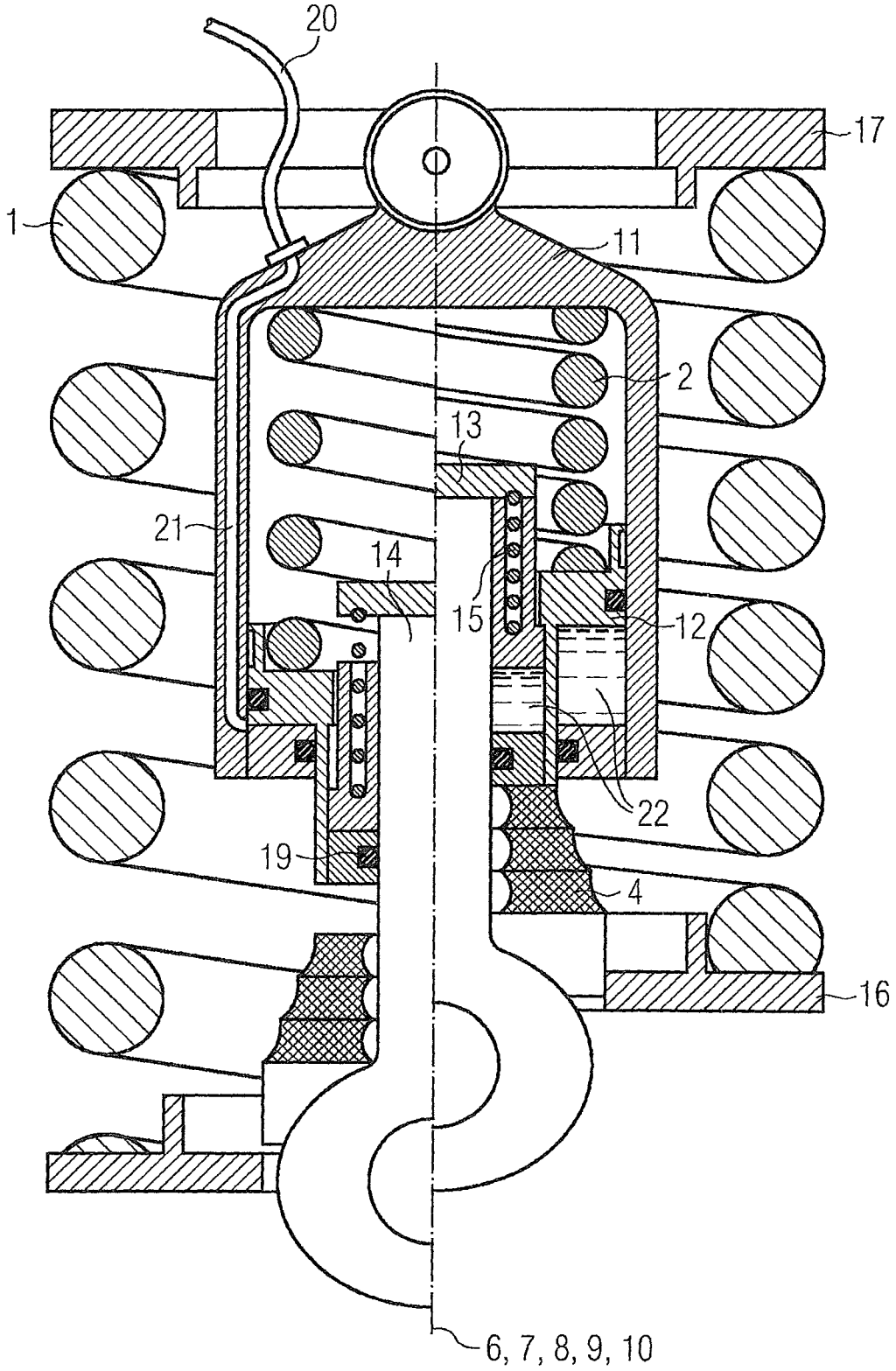
FIG. 4 shows a sectional representation of another exemplary embodiment variant of a spring arrangement in accordance with the invention, where a hydraulic cylinder is shown with a first hydraulic piston and a second hydraulic piston.

If a contact force between the contact body 3 and the first auxiliary spring 4 exceeds a prestressing force FV of the damping spring 2, then the increase of a total spring force FG, which includes a suspension spring force FT, a damping spring force FE and a first auxiliary spring force FZ, is reduced on account of the different progressions illustrated in FIG. 2 of FT, FE and FZ and also on account of the mentioned series and parallel connection. As a result, it is possible to advantageously reduce forces that are required for lowering the car body and that must be applied against the total spring force FG, for example, by a hydraulic cylinder 11 that is illustrated in FIG. 3 and FIG. 4. The spring arrangement comprises, for lower forces than FV (drive operation), a different stiffness progression than for greater forces (in an operation where the vehicle stops at stations).

FIG. 3 illustrates a second exemplary embodiment variant of a spring arrangement in accordance with the invention, where the same reference numerals are used as in FIG. 1.

In contrast to FIG. 1, FIG. 3 illustrates a housing 18 that is configured as a hydraulic cylinder 11. The hydraulic cylinder 11 is connected via its upper face to a cover plate 17 of a suspension spring 1. The cover plate 17 is connected to a car body. The hydraulic cylinder 11 is sealed against its environment via a seal 19.

A contact body 3 that is configured as a first hydraulic piston 12 and contacts a damping spring 2 is actuated via a defined pressure of a hydraulic fluid 22 via a hydraulic connection 20 and a line path 21.

The left-hand side region of FIG. 3 illustrates a non-actuated state of the hydraulic cylinder 11 and the right-hand side region illustrates an actuated state. A piston rod 14 is arranged in a coaxial manner with respect to the first hydraulic piston 12. The first hydraulic piston 12 and the piston rod 14 protrude into the hydraulic cylinder 11. In the actuated state of the hydraulic cylinder 11, the first hydraulic piston 12 is raised in contrast to the non-actuated state and contacts the piston rod 14, as a result of which the piston rod 14 may move upward with the first hydraulic piston 12.

The piston rod 14 is connected via its lower face to a running gear. In accordance with the invention, it is also conceivable to connect the piston rod 14 to the car body. If the first hydraulic piston 12 moves upward, on the one hand, then the damping spring 2 is compressed and, on the other hand, the distance between the car body and the running gear is reduced as a result of the movement of the piston rod 14. The height of the car body is adjusted in this manner.

In the case of a contact (not illustrated in FIG. 3) between the first hydraulic piston 12 and a first auxiliary spring 4 that is arranged below the first hydraulic piston 12 on a base plate 16 of the suspension spring 1, said base plate being connected to the running gear, on account of the prestressing of the damping spring 2, a reduction is achieved of the forces that are to be applied by the hydraulic cylinder 11 against the effect of the suspension spring 1 and also against the first auxiliary spring 4 so as to adjust the height, as described in connection with FIG. 1 and FIG. 2.

FIG. 4 illustrates a another exemplary embodiment of a spring arrangement in accordance with the invention, where the same reference numerals are used as in FIG. 1 and in FIG. 3.

FIG. 4 illustrates a housing 18 that is configured as a hydraulic cylinder 11. The hydraulic cylinder 11 is connected via its upper face to a cover plate 17 of a suspension spring 1. The cover plate 17 is connected to a car body. The hydraulic cylinder 11 is sealed against its environment via a seal 19. A first hydraulic piston 12 that contacts a damping spring 2 is actuated by hydraulic fluid 22 via a hydraulic connection 20 and a line path 21.

The left-hand side region of FIG. 4 illustrates a non-actuated state of the hydraulic cylinder 11, and the right-hand side region illustrates an actuated state. In contrast to FIG. 3, a second hydraulic piston 13 is arranged in the hydraulic cylinder 11, where the second hydraulic piston 13 is likewise actuated by a hydraulic fluid 22, where the same pressure acts on the first hydraulic piston 12 and the second hydraulic piston 13. The second hydraulic piston 13 is connected in series to the first hydraulic piston 12.

The first hydraulic piston 12 acts, in this case, on the damping spring 2 and the second hydraulic piston 13 acts on the piston rod 14. The piston rod 14 is connected to the running gear, and therefore follows the dynamic movements of the running gear, for example, while the vehicle is traveling. These movements act via its connection to the piston rod 14 on the second hydraulic piston 13. As a result, the damping spring 2 is decoupled therefrom and may therefore be configured in a compact manner.

During an upward movement of the second hydraulic piston 13, the first hydraulic piston 12 also moves upward and compresses the damping spring 2. The second hydraulic piston 13 is connected to the piston rod 14, where a compression spring 15 is arranged between the second hydraulic piston 13 and the piston rod 14. As a result of this connection, the piston rod 14 likewise moves upward during an upward movement of the second hydraulic piston 13. As already mentioned in connection with FIG. 3, a movement of the piston rod 14 adjusts the height of the car body.

Following the actuation of the hydraulic cylinder 11, i.e., during the reduction of the pressure in the hydraulic cylinder 11, the compression spring 15 causes the second hydraulic piston 13 to reset.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A spring arrangement for a vehicle having at least one car body and at least one running gear, the spring arrangement comprising:

at least one suspension spring;

at least one pre-stressed damping spring;

a contact body which is connected to the at least one damping spring; and at least one first auxiliary spring are provided;

wherein a first longitudinal axis of the at least one suspension spring, a second longitudinal axis of the at least one damping spring, a third longitudinal axis of the contact body and a fourth longitudinal axis of the at least first auxiliary spring are arranged parallel to one another; and wherein the contact body is arranged between the at least one damping spring and the at least first auxiliary spring.

2. The spring arrangement as claimed in claim 1, wherein the at least one damping spring is arranged connectable in series with respect to the at least first auxiliary spring.

3. The spring arrangement as claimed in claim 2, wherein the at least one suspension spring is arranged connectable in parallel with respect to the at least one damping spring and the at least first auxiliary spring.

4. The spring arrangement as claimed in claim 1, wherein the at least one suspension spring is arranged connectable in parallel with respect to the at least one damping spring and the at least first auxiliary spring.

5. The spring arrangement as claimed in claim 1, wherein the fourth longitudinal axis of the at least first auxiliary spring is arranged parallel to a fifth longitudinal axis of a second auxiliary spring.

6. The spring arrangement as claimed in claim 1, further comprising:

a hydraulic cylinder; and a first hydraulic piston which contacts the at least one damping spring that is arranged in the hydraulic cylinder, said first hydraulic piston being arranged to protrude into the hydraulic cylinder.

7. The spring arrangement as claimed in claim 6, further comprising:

a piston rod arranged to protrude into the hydraulic cylinder.

8. The spring arrangement as claimed in claim 7, wherein the piston rod is connected to the at least one running gear.

9. The spring arrangement as claimed in claim 8, wherein the first hydraulic piston is configured as an actuator with respect to the piston rod.

10. The spring arrangement as claimed in claim 8, further comprising:

a second hydraulic piston arranged in the hydraulic cylinder;

wherein the second hydraulic piston is configured as an actuator with respect to the first hydraulic piston and is connected to the piston rod via a compression spring.

11. The spring arrangement as claimed in claim 7, wherein the piston rod is connected to the at least one car body.

12. The spring arrangement as claimed in claim 11, wherein the first hydraulic piston is configured as an actuator with respect to the piston rod.

13. The spring arrangement as claimed in claim 11, further comprising:

a second hydraulic piston arranged in the hydraulic cylinder;

wherein the second hydraulic piston is configured as an actuator with respect to the first hydraulic piston and is connected to the piston rod via a compression spring.

14. The spring arrangement as claimed in claim 1, wherein the at least one suspension spring is configured as a secondary spring.

15. The spring arrangement as claimed in claim 1, wherein the at least one suspension spring comprises a helical spring.

16. The spring arrangement as claimed in claim 1, wherein the at least one damping spring comprises a helical spring.

17. The spring arrangement as claimed in claim 1, wherein at least the first auxiliary spring comprises an elastomer spring.

18. The spring arrangement as claimed in claim 1, wherein the second auxiliary spring comprises a layer spring.

19. The spring arrangement as claimed in claim 1, wherein the vehicle is a rail vehicle.

* * * * *